United States Patent [19]

Junek et al.

[11] Patent Number: 4,495,762

[45] Date of Patent: Jan. 29, 1985

[54] APPARATUS FOR SEPARATING FIBERS IN OPEN-END SPINNING UNITS

[75] Inventors: Jan Junek, Dukla; Václav Vorborník, Komenskeho Letohrad; Josef Ripka, Tvardkova; Frantisek Jaros, Dukla; Ludmila Lihtarová, Dukla; Frantisek Hortlík, Dukla; Zdenek Kotrba, Tvardkova; Bozena Reháckova; Ladislav Dvorák, both of Polska, all of Czechoslovakia

[73] Assignee: Vyzkumny ustav bavlnarsky, Usti nad Orlici, Czechoslovakia

[21] Appl. No.: 468,887

[22] Filed: Feb. 23, 1983

[30] Foreign Application Priority Data

Mar. 4, 1982 [CS] Czechoslovakia ..... 1465-82

[51] Int. Cl.[3] ..... D01H 7/888

[52] U.S. Cl. ..... 57/411; 57/301; 57/304

[58] Field of Search ..... 57/301, 302, 304, 408, 57/409, 411, 415

[56] References Cited

U.S. PATENT DOCUMENTS

| | | | |
|---|---|---|---|
| 3,792,575 | 2/1974 | Doudlebsky et al. | 57/411 X |
| 3,826,071 | 7/1974 | Grau | 57/301 |
| 3,892,063 | 7/1975 | Doudlebsky et al. | 57/411 X |
| 3,986,327 | 10/1976 | Kobayashi | 57/301 |
| 4,009,562 | 3/1977 | Stalder | 57/301 |

*Primary Examiner*—John Petrakes

[57] ABSTRACT

Apparatus for separating fibers in open-end spinning units having a fiber separating cylinder in a cavity of a housing in which on a cylindrical surface there is provided a cleaning aperture with an impurity separating duct which latter opens by its impurity rebounding wall into a cylindrical impurity collecting chamber communicating, on the one hand, with an air supply aperture and, on the other hand, with an impurity sucking-off duct. In accordance with the invention at least one of the walls of the impurity sucking-off duct tangentially merges into the cylindrical wall of the cylindrical impurity collecting chamber, and the height of said sucking-off duct in the region of joining said collecting chamber is the same as or larger than the height of the outlet from said impurity separating duct into said collecting chamber.

4 Claims, 4 Drawing Figures

APPARATUS FOR SEPARATING FIBERS IN OPEN-END SPINNING UNITS

This invention relates to an apparatus for separating fibers in open-end spinning units, said units comprising a fiber separating cylinder in a cavity of a housing in which on a cylindrical surface there is provided a cleaning aperture with an impurity separating duct. The impurity separating duct opens by its impurity rebounding wall into a cylindrical impurity collecting chamber communicating, on the one hand, with an air supply aperture and, on the other hand, with an impurity sucking-off duct.

The problem of an unwanted return of once separated impurities back to the fiber separating cylinder, and consequently up into the interior of the spinning rotor where they tend to deposit, has been solved by the apparatus for separating fibers in open-end units disclosed in U.S. Pat. No. 3,892,063 to Doudlebsky et al. The impurities deposited in the collecting channel of the spinning rotor influence not only the quality of final yarn products, but also the economy of operation, since they have to be periodically removed during the downtimes of the machine.

In the above-known apparatus disclosed in the Doudlebsky et al patent, a cleaning aperture is followed by an impurity separating duct which tangentially opens by its impurity rebounding wall into a cylindrical impurity collecting chamber. The cylindrical collecting chamber communicates by its lower portion with a sucking-off duct which is disposed in the lower part outside the level of its separating duct. Impurities which fly off the separating cylinder through said separating duct into said cylindrical collecting chamber are mostly sucked-off by said sucking-off duct. Another portion of impurities, and particularly those which have entered the upper portion of said cylindrical collecting chamber, follows a helical path around the periphery of said cylindrical collecting chamber downwardly to the sucking-off duct. Since said cylindrical collecting chamber is supplied from above with air through an air supply aperture, and said air flows not only toward the sucking-off duct but also into the separating duct, a portion of the impurities returns back into the separating duct and reaches the separating cylinder so that it finally enters the spinning rotor.

The problems as hereinabove set forth has been partially solved by the apparatus disclosed in Czechoslovak Inventor's Certificate No. 213,244. The apparatus therein disclosed also has a cylindrical collecting chamber in which, however, there is arranged a baffle plate. It is admitted that such measure has raised the efficiency of impurity removal to some extent, but that the apparatus disclosed in such Inventor's Certificate constitutes only a partial solution of the problem. Apart from this, such measure is time-consuming and complicated, not only from the view point of attachment of such baffle plate, but also in technological respects. During the removal of impurities, namely, there is simultaneously also removed that part of the fibers which have adhered to said baffle plate, so that fiber agglomerations are produced which may choke the ejecting channels and the like. Since the cylindrical collecting chamber is supplied with air from above, a portion of such air, as hereinabove set forth, is conveyed into the separating duct so that a portion of the impurities, sometimes together with entrapped fibers, is carried along back into the separating duct and consequently to the separating cylinder.

It is among the objects of the present invention to solve the problem of an effective removal of separated impurities out of the cylindrical collecting chamber by means of a relatively simple measure so as to prevent the impurities from being returned back into the impurity separating duct and finally to the fiber separating cylinder.

In accordance with the invention, this problem is solved by having the impurity sucking-off duct tangentially merge by at least one of its walls into the cylindrical wall of the cylindrical impurity collecting chamber, the height of said sucking-off duct in the region of joining said collecting chamber being made the same as or larger than the height of the outlet from said impurity separating duct into said collecting chamber.

In accordance with another feature of the invention, the bottom of the cylindrical impurity collecting chamber lies in the same plane as the bottom walls of the impurity separating duct, and the separating sucking-off duct, respectively.

Preferably the two walls of the sucking-off duct merge tangentially into the cylindrical wall of the cylindrical impurity collecting chamber and converge toward the outlet into a following impurity ejecting duct.

The invention will be more readily understood by reference to the accompanying drawings showing preferred embodiments of the apparatus according to the invention. In the drawings.

Figure 1:
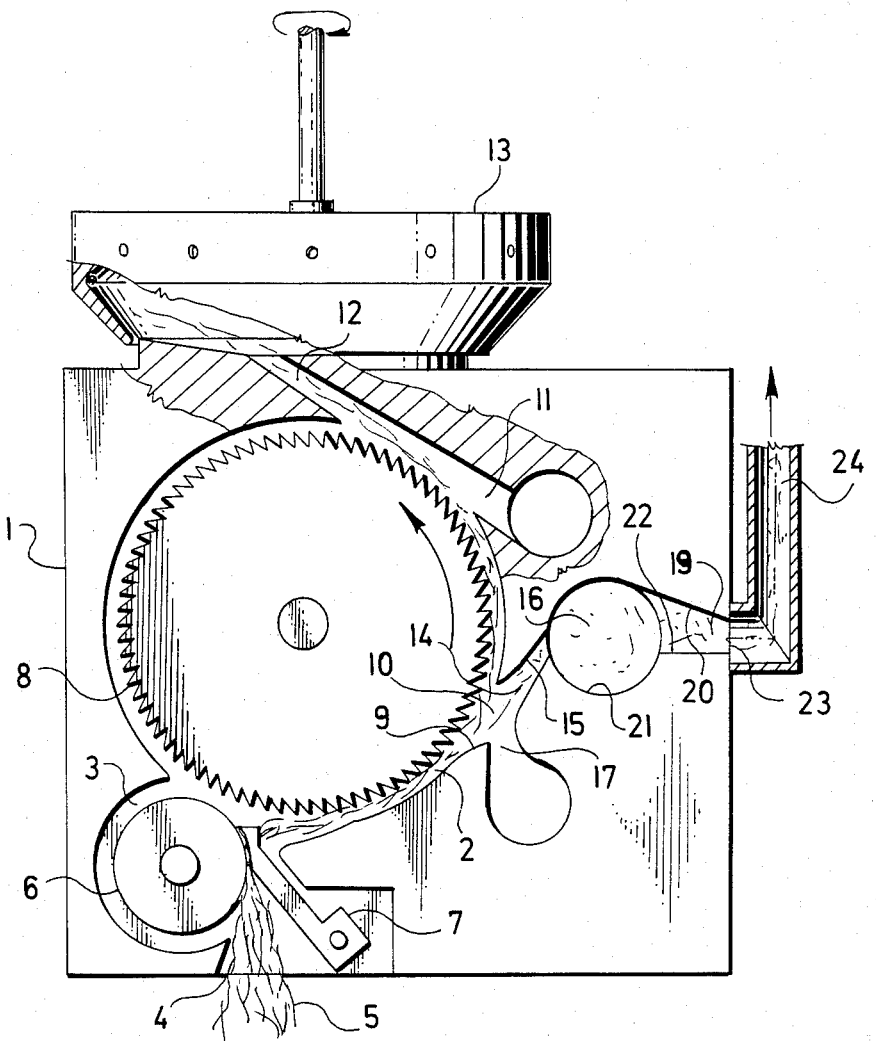
FIG. 1 is a top plan view of an open-end spinning unit together with the fiber separating mechanism associated therewith, the cover for the housing having been removed, such view illustrating a cylindrical impurity collecting chamber communicating with a separating duct and a sucking-off duct.

Turning first to FIG. 1, the fiber separating device comprises a housing 1 with a cylindrical cavity 2 which communicates in its lower lefthand part as it is shown in FIG. 1 with a recess 3. The recess 3 contains a known sliver supply device 4 comprising a feed roller 6 and a feed shoe 7. The cylindrical cavity 2 receives a known fiber separating cylinder 8 designed for combing individual fibers from a supplied fibrous sliver 5.

Figure 2:
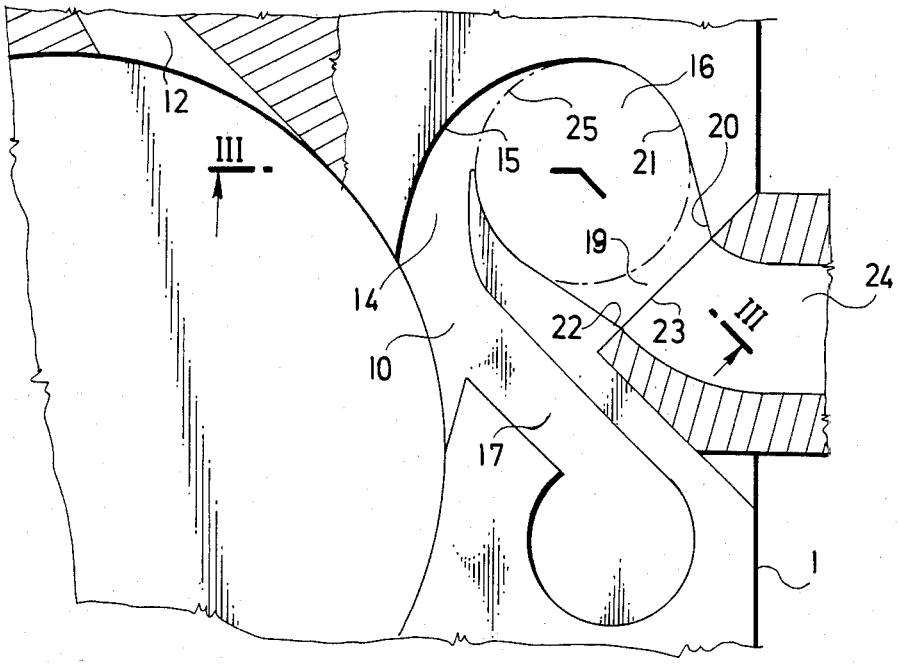
FIG. 2 is a detail view in top plan on an enlarged scale showing a preferred connection between the sucking-off duct and the cylindrical collecting chamber.

On the cylindrical surface 9 of said cylindrical cavity 2 there is provided a cleaning aperture 10 which is followed, in the direction of rotation of the serrated separating cylinder 8, by the mouth 11 of a fiber supply duct 12 which opens into a known spinning rotor 13 arranged in a spinning housing (not shown). It is to be understood that such cleaning aperture 10 can also be provided in close proximity to the mouth 11 of said fiber supply duct 12, which, however, is irrelevant for the present invention. The cleaning aperture 10 opens into an impurity separating duct 14, the impurity rebounding wall 15 of duct 14 tangentially entering a cylindrical impurity collecting chamber 16. A known air supply duct 17 opens into said impurity separating duct 14. The cylindrical impurity collecting chamber 16 is supplied with air from above by an air supply aperture 18 provided in a cover 29 for housing 1, such cover being shown in both FIGS. 3 and 4. The impurity collecting chamber 16 communicates with an impurity sucking-off duct 19. Duct 19 tangentially merges by at least one wall, wall 20 in this instance, into the cylindrical wall 21 of the cylindrical impurity collecting chamber 16; this relationship is apparent from FIG. 1. As can be seen in the modified construction depicted in FIG. 2, the two walls 20, 22 of the impurity sucking-off duct 19 preferably tangentially merge into the cylindrical wall 21 of said collecting chamber 16, and converge to an outlet 23 opening into an impurity ejecting duct 24. Duct 24 communicates with a central conduit extending along the spinning machine (not shown).

In the region wherein the sucking-off duct 19 merges into the collecting chamber 16, the height H (FIG. 3) of the former is preferably the same as, or larger than, the height F of the outlet 25 of the separating duct 14 which leads into the cylindrical collecting chamber 16.

Figure 3:
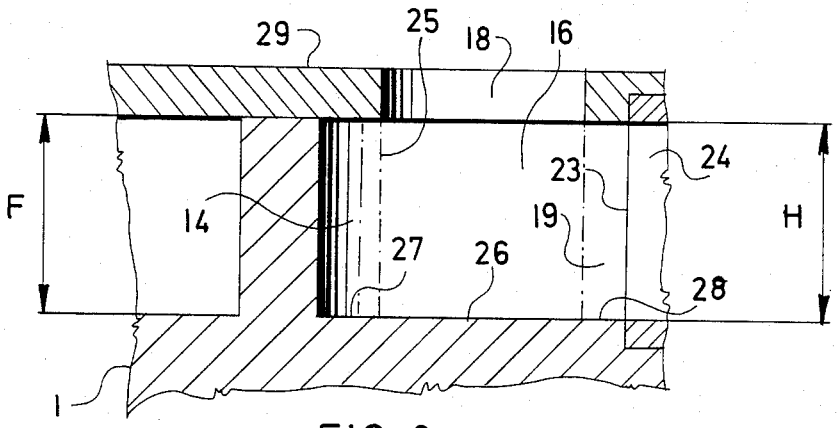
FIG. 3 is view in vertical section through the impurity collecting chamber of the apparatus of FIG. 2, the section being taken along the broken section line III—III in FIG. 2.

When the height H is the same as the height F, as shown in FIG. 3, the bottom 26 of the collecting chamber 16 is preferably aligned with the respective bottom walls 27, 28 of the separating duct 14 and the sucking-off duct 19.

Figure 4:
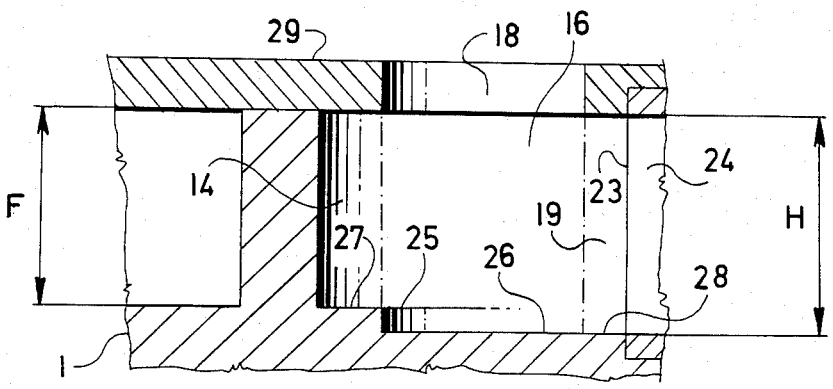
FIG. 4 is a view similar to FIG. 3 but showing an alternative embodiment of the impurity collecting chamber.

If the height H of the sucking-off duct 19 is larger than the height F of the separating duct 14, the bottom 26 of the cylindrical collecting chamber 16 is at the level of the bottom wall 28 of the sucking-off duct 19, as shown in FIG. 4.

However, it is preferable that the bottom walls 27, 28 and the bottom 26 of the collecting chamber 16 are at the same level, since such arrangement reduces air whirling to a minimum; such whirls, namely, are responsible for the deposition of impurities in the cylindrical collecting chamber 16, or even for the return thereof back into the separating duct 14.

The above-described apparatus operates as follows: Fibrous sliver 5 is supplied by the feed roller 6 to the separating cylinder 8 which, due to its toothed clothing, combs individual fibers out of the sliver 5 and conveys them to the mouth 11 of the fiber supply duct 12 and further on into the spinning rotor 13. During such travel of the sliver, impurities contained therein simultaneously become loosened therefrom. The impurities are conveyed, due to centrifugal force, through the cleaning aperture 10 into the separating duct 14, and further on into the cylindrical collecting chamber 16. Although an air whirl is produced in the collecting chamber 16, the impurities are conveyed along the cylindrical wall 21 thereof and then along the wall 20 of the sucking-off duct 19 toward the impurity ejecting duct 24, said wall 21 tangentially merging into said wall 20 of the sucking-off duct 19.

Thus the impurities do not advance along the cylindrical wall 21 up to the outlet 25 of the separating duct 14 where they may be entrained back into said separating duct 14 by a part of the air stream supplied through the supply aperture 18. It is particularly in the case of a tangential connection of the two walls 20, 22 of the sucking-off duct 19 to the cylindrical collecting chamber 16, and of a convergence thereof toward the outlet 23 of the impurity ejecting duct 24, that any return of impurities is prevented. The converging walls 20, 22 of the sucking-off duct 19 cause an acceleration of air toward the ejecting duct 24, and consequently provide for an effective and reliable impurity removal.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. In an apparatus for separating fibers in open-end spinning units, said apparatus having a fiber separating cylinder in a cavity of a housing in which on a cylindrical surface there is provided a cleaning aperture with an impurity separating duct which latter opens by its impurity rebounding wall into a cylindrical impurity collecting chamber communicating, on the one hand, with an air supply aperture and, on the other hand, with an impurity sucking-off duct having a first and a second wall, the improvement wherein the first wall of the sucking-off duct tangentially merges into the cylindrical wall of the cylindrical impurity collecting chamber downstream of the outlet of the impurity separating duct and is oriented in the direction of rotation of an air vortex in said cylindrical collecting chamber toward an impurity ejecting duct the axial height of said sucking-off duct in the region of joining said collecting chamber is the same as or larger than the axial height of the outlet from said impurity separating duct into said collecting chamber.

2. An apparatus as claimed in claim 1, wherein the second wall of the sucking-off duct also tangentially merges into the cylindrical wall of the cylindrical impurity collecting chamber.

3. An apparatus as claimed in claim 1, wherein the end wall of the cylindrical impurity collecting chamber lies in the same plane as the end walls of the impurity separating duct and the impurity sucking-off duct, respectively.

4. An apparatus as claimed in either claim 1 or claim 3, or in two opposite walls of the sucking-off and tangentially merge into the cylindrical wall of the cylindrical impurity collecting chamber at opposed spaced locations and converge toward the outlet into a following impurity injecting duct.

* * * * *